US010927577B2

(12) United States Patent
Kruedener et al.

(10) Patent No.: US 10,927,577 B2
(45) Date of Patent: Feb. 23, 2021

(54) DEVICE FOR MOVING A FURNITURE PART, AND ITEM OF FURNITURE

(71) Applicant: Grass GmbH, Reinheim (DE)

(72) Inventors: Boris Kruedener, Kleinostheim (DE); Sebastian Lautenschlaeger, Seeheim-Jugenheim (DE); Martin Staude, Reinheim (DE)

(73) Assignee: Grass GmbH, Reinheim (DE)

( * ) Notice: Subject to any disclaimer, the term of this patent is extended or adjusted under 35 U.S.C. 154(b) by 0 days.

(21) Appl. No.: 16/382,463

(22) Filed: Apr. 12, 2019

(65) Prior Publication Data

US 2019/0316397 A1 Oct. 17, 2019

(30) Foreign Application Priority Data

Apr. 17, 2018 (DE) ..... 20 2018 102 088.9

(51) Int. Cl.
*E05F 1/08* (2006.01)
*E05D 5/02* (2006.01)
(Continued)

(52) U.S. Cl.
CPC ..... *E05D 5/0276* (2013.01); *E05D 3/12* (2013.01); *E05F 3/18* (2013.01); *E05Y 2900/20* (2013.01)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 2,720,676 A * 10/1955 Vigmostad ..... E05D 3/16 16/289
5,211,457 A * 5/1993 Lupynec ..... A47B 63/02 16/370
(Continued)

FOREIGN PATENT DOCUMENTS

DE 20 2017 102 809 U1 9/2018
EP 2 309 086 A1 4/2011
(Continued)

OTHER PUBLICATIONS

Extended European Search Report (Application No. 19168566.8) dated Sep. 27, 2019.
(Continued)

*Primary Examiner* — Chuck Y Mah
(74) *Attorney, Agent, or Firm* — Burr & Brown, PLLC

(57) ABSTRACT

A device for moving a furniture part held on a furniture body of an item of furniture having a guide with at least one pivot arm for pivoting the furniture part from a closed position into an open position relative to the furniture body and back with a base unit with an anchor plate. The device includes a positioning mechanism with a positioning portion formed in an intermediate region between the at least one pivot arm and the base unit. During a pivoting movement of the pivot arm, the positioning portion contacts an abutment surface on the pivot arm and/or on the base unit. Fine positioning of the pivot arm in an axial direction relative to its pivot axis is configurable by contact of the positioning portion with the abutment surface if the pivot arm has an axial offset with respect to a setpoint bearing position of the pivot arm.

13 Claims, 4 Drawing Sheets

(51) Int. Cl.
*E05D 3/12* (2006.01)
*E05F 3/18* (2006.01)

(58) Field of Classification Search
CPC ..... E05F 1/14; E05F 3/20; E05D 3/06; E05D 3/12; E05D 3/16; E05D 3/18; E05D 5/0276; E05D 11/00; E05D 11/11; E05Y 2201/21; E05Y 2201/264; E05Y 2201/47; E05Y 2201/492; E05Y 2201/618; E05Y 2900/20; E05Y 2900/202; A47B 2220/0072; Y10T 16/5383; Y10T 16/547; Y10T 16/5476; Y10T 16/5357; Y10T 16/5358; Y10T 16/5363; Y10T 16/5367
See application file for complete search history.

(56) References Cited

U.S. PATENT DOCUMENTS 5,307,539 A * 5/1994 Bauman ..... E05D 7/0054 16/235
5,450,654 A * 9/1995 Sullivan ..... E05C 17/32 16/362
5,544,388 A * 8/1996 Chiura ..... E05D 3/145 16/375
5,664,290 A * 9/1997 Scherrer ..... E05D 3/06 16/370
5,765,261 A * 6/1998 Hung ..... E05D 3/18 16/278
6,138,325 A * 10/2000 Figliola ..... E05D 15/32 16/363
6,367,123 B1 * 4/2002 Cheal ..... E05D 3/145 16/289
6,442,799 B1 * 9/2002 Duarte ..... E04H 4/084 16/277
7,197,790 B1 * 4/2007 Edmondson ..... E05D 3/16 16/286
7,797,796 B2 * 9/2010 Migli ..... E05D 15/46 16/286
8,321,996 B2 * 12/2012 Hirtsiefer ..... E05D 15/46 16/286
8,468,656 B2 * 6/2013 Bauman ..... E05D 15/30 16/199
8,959,709 B2 * 2/2015 Hasegawa ..... E05D 3/14 16/65
9,464,473 B2 * 10/2016 Baldreich ..... E05F 1/1058
9,624,709 B2 * 4/2017 Friesenecker ..... E05F 15/63
2012/0260461 A1 * 10/2012 Lautenschlager ..... E05F 5/10 16/352
2017/0044812 A1 * 2/2017 Schluge ..... E05F 1/1058
2018/0363348 A1 * 12/2018 Schluge ..... E05F 1/1253
2019/0285335 A1 * 9/2019 Hunter ..... E05D 11/1014

FOREIGN PATENT DOCUMENTS

EP 2559835 A1 * 2/2013 ..... E05F 1/1261
EP 3401476 A1 * 11/2018 ..... E05D 15/401
FR 2 513 300 A 3/1983
GB 2 148 384 A 5/1985

OTHER PUBLICATIONS

German Search Report (Application No. 20 2018 102 088.9) dated Mar. 14, 2019.

* cited by examiner

DEVICE FOR MOVING A FURNITURE PART, AND ITEM OF FURNITURE

This application claims the benefit under 35 USC § 119(a)-(d) of German Application No. 20 2018 102 088.9 filed Apr. 17, 2018, the entirety of which is incorporated herein by reference.

FIELD OF THE INVENTION

The present invention relates to a device for moving a furniture part, and item of furniture.

BACKGROUND OF THE INVENTION

Devices are known for moving a furniture part which is held on a furniture body of an item of furniture. For this purpose, guides of the device with at least one pivot arm for pivoting the furniture part are provided, with which the guide, when the device has been installed, the furniture part can be moved from a closed position into an open position of the furniture part relative to the furniture body and back.

Such a device has, for example, a base unit with an anchor plate on which the guide engages such that a pivot axis about which the at least one pivot arm is pivotable is transverse with respect to an anchor plate plane spanned by the anchor plate. The devices are, for example, furniture fittings such as flap or top flap fittings. In the case of modern furniture, particularly space-saving and visually appealing accommodation of the movement device is desired. In general, the pivotable furniture part is held on a furniture body by means of two similar units of the movement device.

SUMMARY OF THE INVENTION

It is an object of the present invention to improve a device for moving a furniture part held movably on a furniture body, with a guide for pivoting the furniture part, in particular, with regard to the avoidance of undesired noises or heaviness of the pivot arm movement owing to a small axial misalignment of the pivot arm relative to the pivot axis. These scenarios may arise, for example, in practice owing to deviations between an actual position of a pivot arm of the pivot arm arrangement and an ideal position and/or owing to component tolerances.

The present invention is based on a device for moving a furniture part held on a furniture body of an item of furniture, a guide of the device with at least one pivot arm for pivoting the furniture part being provided, with which the guide, when the device has been installed, the furniture part can be moved from a closed position into an open position of the furniture part relative to the furniture body and back, the device having a base unit with an anchor plate on which the guide engages such that a pivot axis about which the at least one pivot arm is pivotable is transverse with respect to an anchor plate plane spanned by the anchor plate.

The device comprises, in particular, the body-side base unit, the guide with a pivot arm arrangement, preferably with a force store and/or a damping arrangement, and a flap-side mounting unit. The base unit comprises the anchor plate with an anchor plate cover mountable thereon, or a housing plate.

A cover such as, for example, a covering cap or a covering plate is preferably mountable on the anchor plate cover. In general, a face-side fitting cover is also provided on the base unit.

In the case of relatively large furniture flaps to be moved, the components of the movement device must be designed to be adequately stable. For a high level of operating convenience, it is the case, in particular, that force assistance is provided with the force store for the opening movement, and/or the damping arrangement is provided for the damped closing movement of the furniture part.

The essence of the present invention can be seen in the fact that the device comprises a positioning mechanism with a positioning portion, the positioning portion being formed in an intermediate region between the at least one pivot arm and the base unit, the positioning portion being provided such that, during a pivoting movement of the at least one pivot arm, the positioning portion comes into contact with an abutment surface, the abutment surface being provided on the pivot arm and/or on the base unit, fine positioning of the pivot arm in an axial direction relative to the pivot axis of the pivot arm being configurable by means of the contact of the positioning portion with the abutment surface if the pivot arm has an axial offset with respect to a setpoint bearing position of the pivot arm. In this way, the furniture part can be pivoted from the open position into the closed position without unpleasant and undesired noises, even if a pivot arm or possibly multiple interconnected pivot arms of the pivot arm arrangement have a relatively small misalignment. A misalignment of a pivot arm may in practice generally occur, for example, with a bearing position offset, which arises, for example, with a deviation in the range of a fraction of a millimeter as regards the relative position, for example, with respect to an ideal or setpoint bearing position on the pivot axis of the pivot arm.

Without a positioning mechanism according to the present invention, the small offset can give rise, during the pivoting of the pivot arm into a receiving space of the base unit into the closed position of the furniture part, to intense friction and jamming noises and/or a slowed and/or jerky closing movement of the furniture part owing to undefined friction states between the pivot arm and the base unit or the anchor plate and/or housing plate thereof. This is ruled out, or at least minimized, according to the present invention by virtue of a positioning mechanism, with the positioning portion, being provided which advantageously influence the friction of the surfaces involved. With the positioning mechanism, an existing offset of the bearing position of the pivot arm at least during the pivoting of the furniture part is compensated or overcome. This is advantageously realized in a predefinable manner with a defined adjustment of the pivot arm out of the misaligned position, before the closing or pivoting-in in the case of an open furniture part on the furniture body, in the direction of the ideal or setpoint bearing position, which takes place by abutment of the positioning portion against the abutment surface during the pivoting-in movement.

With the positioning mechanism, a pivot guide facility for the unstable pivot arm is advantageously provided, which, owing to the offset with respect to the ideal bearing position, constitutes at least partially unstable movement bearing. The instability of the movement bearing is overcome using the positioning mechanism.

The contact of the positioning portion with the abutment surface occurs during the pivoting movement and is eliminated possibly only in the final portion of the pivoting travel before the fully open pivoting position is reached. The contact of the positioning portion with the abutment surface is advantageously a friction-minimized sliding contact. The positioning mechanism accordingly provides a part of a slide bearing guide for the pivot arm.

The positioning mechanism and the pivot arm arrangement are coordinated such that, in an ideal installation situation, in which all of the elements involved assume an ideal or setpoint position, which relates, in particular, to the base unit and the pivot arm arrangement with a setpoint bearing situation of the pivot arm, a small air gap is present between outer sides of the at least one pivot arm and opposite portions of the base unit or of the anchor plate and of the cover plate.

The air gap amounts to, for example, a fraction of a millimeter, such that, in the case of ideal conditions, the pivot arm, during the pivoting movement, moves past the opposing portions in contact-free fashion, or the abutment surfaces and the associated positioning portions are, or remain, without contact.

The abutment surface is advantageously formed by an outer side of the at least one pivot arm. Thus, the pivot arm can remain unchanged without the need for measures to be provided thereon for realizing friction-minimized contact with the positioning portion. The respective outer side of the pivot arm is, in particular, a portion of the surface of the pivot arm outer side. The outer side is, in particular, that areal side of the pivot arm which is directed in an axial direction toward the pivot axis, or comprises both opposite areal outer sides of the pivot arm.

The two outer sides, which come into contact with the positioning portion, of the pivot arm are preferably formed by the respective outer side of two mutually spaced-apart outer disk-like elements of the pivot arm. The pivot arm is, for example, constructed from two or more disk-like elements which are adjacent in a sandwich-like configuration.

A further advantage lies in the fact that the abutment surface is formed by an inner side of the base unit. Then, the positioning portion is advantageously provided on the pivot arm or on a pivot arm outer side, which is directed toward the inner side of the base unit.

Since, in general, the two opposite outer sides of the pivot arm face toward a respective other inner side of the base unit, it is preferably the case that two different positioning portions act on a pivot arm for the sliding guidance of the pivot arm. In the case of multiple pivot arms, a positioning portion, for example, slide tracks, may be provided on each pivot arm, or preferably in each case at least one positioning portion is provided on opposite outer sides of the multiple pivot arms. Preferably, exactly two positioning portions are provided on each pivot arm, in each case one positioning portion on each of the two opposite outer sides.

It is furthermore advantageous if the abutment surface is provided on the anchor plate of the base unit. The abutment surface is, in a simple case, at least one surface of an inner side of the base unit such as the anchor plate and/or the counterpart plate. The anchor plate is relatively stable with respect to a deformation, whereby, during the sliding movement of the pivot arm, when the positioning portion on the pivot arm presses against the abutment surface, the fine positioning can be realized in an advantageous and/or reliable manner. The anchor plate is in this case supported, with the outer side which is situated opposite the abutment surface so as to be spaced apart therefrom by the material thickness of the anchor plate, areally against the item of furniture or against a base surface of a material recess, for example, in a furniture body side wall. The abutment surface on the anchor plate may be formed by the respective surface of the anchor plate or the surface of the material of the anchor plate itself. Alternatively, the abutment surface may be an element which is additional to the anchor plate and which is attached thereto, such as, for example, a material strip, or the abutment surface is, for example, a material coating on the surface of the anchor plate.

A further advantage arises in that the abutment surface on the base unit is formed exclusively in a region of the base unit which is not swept over by predefined portions of the outer side of the at least one pivot arm during the course of a complete pivoting movement of the pivot arm arrangement. It is thus advantageously possible for portions on the outer side of the pivot arm, which are directed toward the abutment surface, to be kept free from contact with the abutment surface during the pivoting movement of the pivot arm. In particular, the predefined portions of the outer side of the pivot arm are protruding portions which are elevated in relation to the rest of the planar, flat outer side of the pivot arm. The predefined portions are, for example, connecting points on the pivot arm for the connection of components of the pivot arm to one another. Such connecting points are, for example, rivet connecting points of the pivot arm or protruding rivet heads. If the predefined portions of the outer side of the pivot arm are kept free from contact with the abutment surface, the fine positioning of the pivot arm can function in an advantageous manner. Otherwise, elevated portions in contact with the abutment surface or with a positioning portion would lead to an undesired or intensified pressure action between the abutment surface and the pivot arm, or possibly to blockage of the pivoting movement.

According to one advantageous modification of the present invention, the abutment surface is provided on a counterpart plate, situated opposite the anchor plate, of the base unit. The counterpart plate is, for example, a housing plate. The counterpart plate generally has a basic form or an outer contour which corresponds to the basic form or an outer contour of the anchor plate. With the anchor plate and the counterpart plate, the base unit is enclosed on its areal sides and forms a structural unit which can be accommodated on the item of furniture, for example, in a material recess of the furniture body. The pivot axis of at least one pivot arm of the guide between the anchor plate and the counterpart plate is advantageously realized by means of a component, such as, for example, an axle pin, which is received in the anchor plate at one side and in the counterpart plate at the other side.

The pivot arm or the multiple pivot arms of the pivot arm arrangement are mounted on the base unit with the anchor plate and the counterpart plate, wherein the pivot arm arrangement is, in the pivoted-in state of the pivot arm arrangement, accommodated at least approximately entirely in a free intermediate region between the anchor plate and the counterpart plate. Here, it is advantageous if, during the pivoting-in movement of the pivot arm arrangement, the abutment surface is provided on the counterpart plate. It is preferable if a further abutment surface is additionally formed on the anchor plate, in particular, at a corresponding location, opposite the abutment surface on the counterpart plate. Thus, the pivot arm is subjected to the fine positioning with guidance at least on one side, advantageously on both sides. It is preferable here if, with guidance on both sides and in this case in identical fashion and/or simultaneously via the two outer sides of the pivot arm by the abutment surfaces or positioning portions on the anchor plate and the counterpart plate, the fine positioning is realized with the contact of the pivot arm on both sides with the two abutment surfaces or positioning portions.

It is basically possible for one abutment surface on the anchor plate and/or one abutment surface on the counterpart plate to be formed from exactly one surface unit, or the abutment surface is composed of multiple mutually spaced-apart or separate partial abutment surfaces. The partial abutment surfaces may be similar or identical to one another or may be designed differently in terms of form and condition.

Another advantage of the present invention is realized in that the abutment surface is assigned to a face-side cover element that is attachable to the base unit. The face-side cover element is preferably attached to the anchor plate and/or to the counterpart plate. The base unit, which is preferably in the form of a cassette, has at least one open narrow side between the anchor plate and the counterpart plate. Through this open side, the pivot arm arrangement extends to the movable furniture part on which the pivot arm arrangement engages by means of the mounting unit. Since the base unit with its open narrow side is generally attached to a furniture body side wall such that the narrow side forms a portion of the front face side of the furniture body, the face-side cover element on the base unit is provided on the base unit, for example, for visual reasons and in order to protect against an ingress of dirt into the interior of the base unit, wherein the pivot arm extends through an opening in the face-side cover element. Therefore, the face-side cover element or the edge of the opening in the face-side cover element is advantageously expedient for having attached to it the abutment surface or a slide portion, past which the pivot arm moves during the pivoting-in movement. The abutment surface may be arranged at one side or at exactly one edge of the opening in the face-side cover element or at two opposite edges of the face-side cover element opening, between which the pivot arm moves past. Thus, the fine positioning of the pivot arm in the contact with the one abutment surface, preferably with the two abutment surfaces, can be realized in an advantageous manner at the opening of the face-side cover element.

The at least one abutment surface may also be formed by a portion of the face-side cover element itself, alternatively to an abutment surface attached additionally to the face-side cover element, such as a positioning portion.

The abutment surface is advantageously formed as a positioning portion correspondingly to the positioning portion on the pivot arm. The abutment surface may be formed as a positioning portion, such that two corresponding portions abut against one another.

The multiple positioning portions are preferably formed so as to be identical, in particular, by an attachment element. Thus, in a simple and flexibly configurable manner, for example, by retroactive attachment, a positioning portion or an attachment element can be provided on the pivot arm on one or both outer surface sides thereof. A further positioning portion or a further attachment element may be provided on the base unit or on the anchor plate of the base unit and/or on the counterpart plate of the base unit.

It is thus, for example, possible for a first side of the pivot arm to be equipped with a positioning portion, wherein, during the pivoting of the pivot arm arrangement or of the furniture part, the positioning portion on the pivot arm makes abutting contact with a further positioning portion on the anchor plate. A second side of the pivot arm may likewise be equipped with a positioning portion which, during the pivoting of the pivot arm arrangement or of the furniture part, makes abutting contact with another further positioning portion on the counterpart plate. Thus, two pairs of positioning portions or two friction or slide surface pairs on the pivot arm take effect, wherein, in each pair, a positioning portion performs the function of the abutment surface.

It is preferable if, in the case of a pivot arm, on a first side, multiple, preferably three, slide surface pairs take effect, that is to say three positioning portions on the first pivot arm side and three positioning portions on the anchor plate, and, at the second side of the pivot arm, likewise multiple, preferably three, slide surface pairs positioned correspondingly to the first three slide surface pairs take effect, that is to say three positioning portions on the second pivot arm side and three positioning portions on the counterpart plate.

Accordingly, in the case of each individual one of the three slide surface pairs, two positioning portions make contact with one another.

Thus, a pivot arm can, over its entire pivoting movement, be balanced or in abutting contact at the top in the middle and at the bottom, which counteracts unilateral loads or distortion of the pivot arm on the base unit during the pivoting movement.

It is furthermore advantageous if the positioning portion comprises an attachment element for attachment to the base unit and/or to the pivot arm. The attachment element can advantageously be used in a variable manner. The attachment element is, for example, a strip-like thin component with a flat contact side or positioning portion side with, for example, a uniform thickness of 0.5 to 4.0 millimeters, preferably with a thickness of approximately 2 millimeters. A typical length of the attachment element amounts to, for example, approximately the 5 centimeters with a width of approximately 10 millimeters.

Alternatively, an attachment element may also be provided which has a hoop-shaped or U-shaped component, wherein the attachment element has two separate positioning portions. The positioning portions are then the two limbs of the U-shaped component and, in the attached state on the base unit, engage around the pivot arm at both sides, such that a first positioning portion makes contact with a first side of the pivot arm during the pivoting of the pivot arm and that a second positioning portion makes contact with a second side of the pivot arm during the pivoting of the pivot arm.

In a preferred variant of the present invention, the attachment element is attachable to the base unit and/or to the pivot arm.

The attachment of the attachment element may be realized, for example, in detachable or pluggable or screwable fashion. Alternatively, the attachment may be non-detachable, such as, for example, adhesively bondable.

With regard to the material characteristics, it is advantageous for the positioning portion to be formed from a plastics material. The positioning portion is composed, for example, of a material with a relatively low friction coefficient. Preferably, the positioning portion is formed from a Teflon material, which is a friction-reducing material.

The positioning portion may, for example, be formed as a coating.

Finally, it is advantageous if the base unit is connected via a pivot arm of the guide to a mounting unit, the mounting unit being designed for recessed attachment in the region of a material recess of the furniture part.

In general, the device according to the present invention comprises two identical pivot or fitting units for providing identical pivoting kinematics of the furniture part on both sides, wherein the two fitting units act between the furniture body and the furniture part. The respective base unit of the two fitting units is fastened to the furniture body. The respective mounting unit of the two fitting units is fastened to the furniture part, for example, to the inside at a right-hand side edge and at a left-hand side edge of the furniture part such as a furniture flap. The pivot arm arrangement acts between the base unit and the mounting unit, with one end of the pivot arm arrangement engaging on the base unit and another end of the pivot arm arrangement engaging on the mounting unit, preferably in each case engaging in articulated fashion.

The present invention also extends to an item of furniture having a furniture body and, held thereon, a movable furniture part such as a furniture flap, for example, top flap, with a device as per any of the embodiments discussed above.

BRIEF DESCRIPTION OF THE DRAWINGS

Further features and advantages of the present invention will be discussed in more detail on the basis of exemplary embodiments schematically illustrated in the figures, in which, in detail.

DETAILED DESCRIPTION OF THE INVENTION

Figure 1:
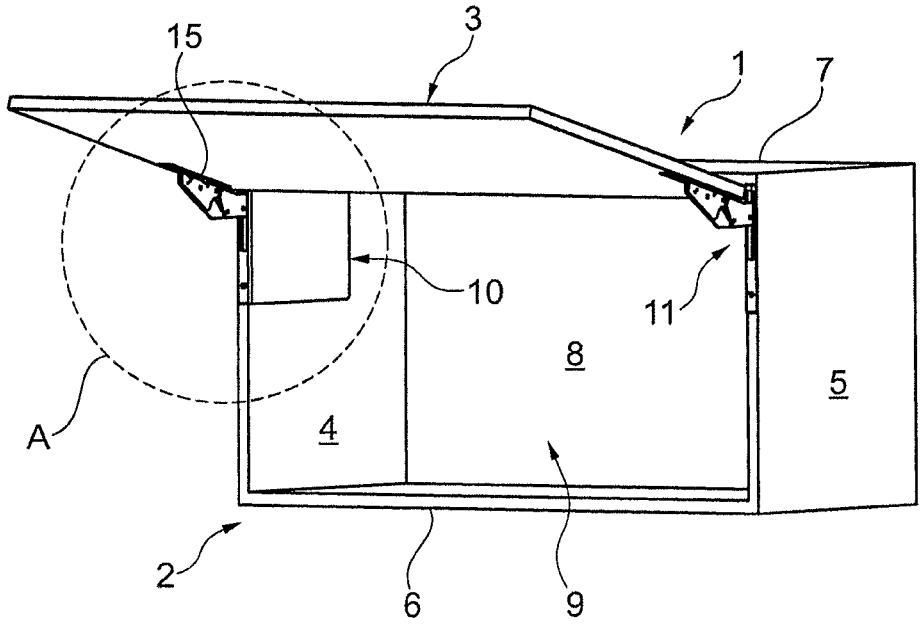
FIG. 1 shows a perspective view of an item of furniture according to the present invention with a device according to the present invention for moving a furniture part, which is illustrated in an open state.

FIG. 1 shows, in a perspective view, an item of furniture according to the present invention or a wall cupboard 1 with a box-like furniture body 2 and with a furniture part held thereon, which furniture part is in the form of a panel-like top flap 3 which is shown in an open position relative to the furniture body 2.

The furniture body 2 comprises two opposite upright side walls 4 and 5, which are connected at the bottom to a bottom side 6 and at the top to a top side 7. At the rear, the furniture body 2 is closed off by a rear wall 8.

For the movement of the top flap 3 about a horizontal pivot axis relative to the furniture body 2 from the open position shown in FIG. 1 into a closed position (not shown) in which the top flap has been moved onto the front side of the furniture body 2, a movement device according to the present invention is provided, which is designed as a top flap fitting 9. The top flap fitting 9 has a first fitting unit 10 at the side wall 4 and has a second fitting unit 11 at the side wall 5, which fitting units are of identical construction but are of side-specific design for the functionally correct arrangement on the respective side wall 4 or 5.

Each fitting unit 10 and 11 comprises a base unit 12, guide 13 with a pivot arm arrangement 14, and a mounting unit 15. By means of multiple articulatedly mounted pivot arms of the pivot arm arrangement 14, the base unit 12 is connected to the mounting unit 15, which is fastened fixedly to an inner side of the top flap 3 so as to be recessed in a material recess.

Furthermore, the guide 13 have a force store 21 for assisting the opening movement of the top flap 3 into the open position and a damper device 22 for a damped closing movement of the top flap 3 into the closed position.

Figure 2:
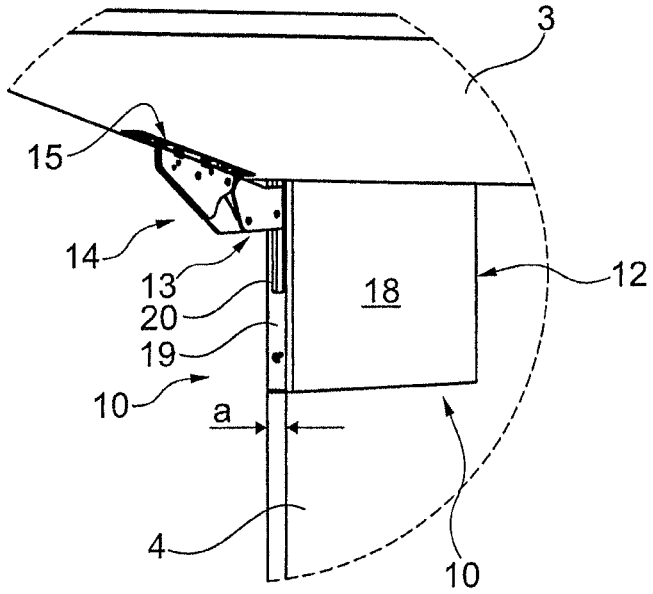
FIG. 2 shows the region A circled in FIG. 1 in an enlarged illustration with a fitting unit of the device.
Figure 3:
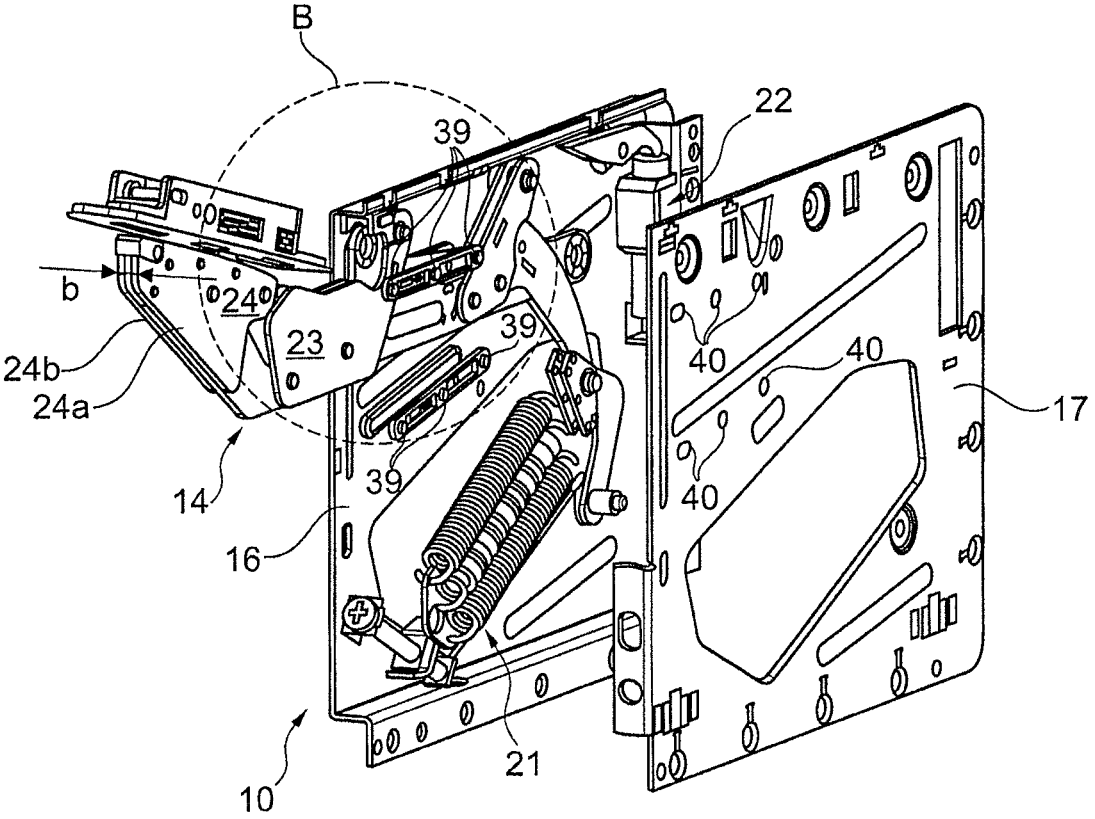
FIG. 3 shows the fitting unit as per FIG. 2 in a perspective view on its own without a cover plate, and with a housing plate illustrated in a raised position.
Figure 4:
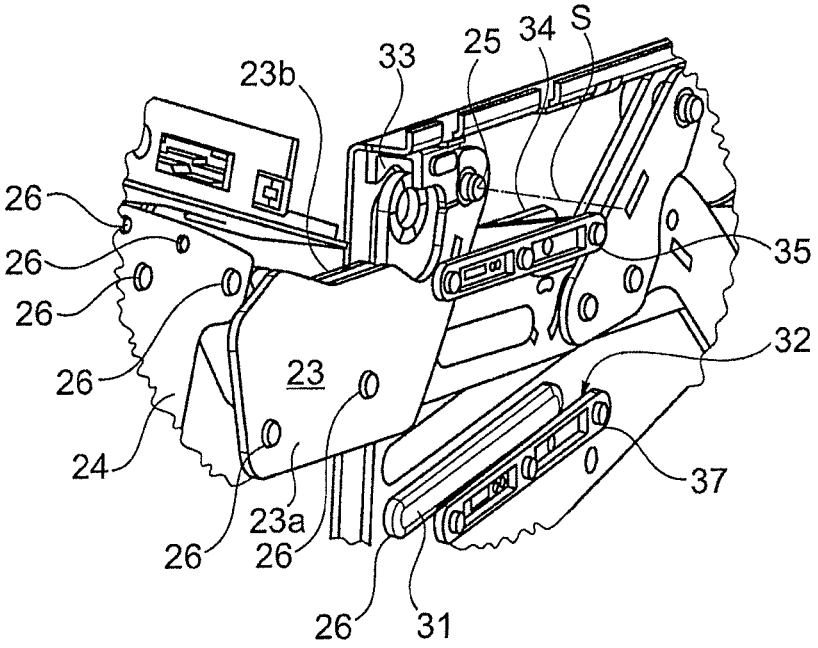
FIG. 4 shows the region B circled in FIG. 3 in an enlarged illustration.
Figure 5:
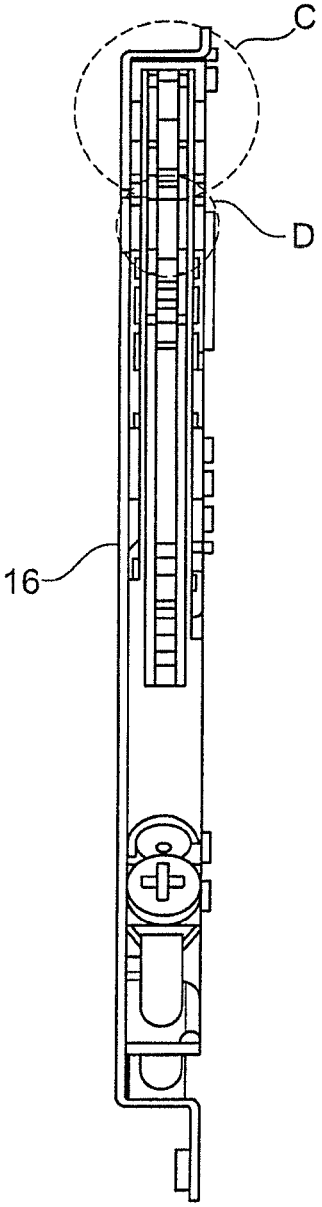
FIG. 5 shows the fitting unit as per FIG. 3 in a frontal view in the assembled state in the case of a pivoted-in pivot arm arrangement, wherein a furniture-part-side mounting unit of the fitting unit and the housing plate have been omitted.

The base unit 12 is preferably formed from a sheet-metal component and comprises a planar, flat or thin anchor plate 16 and a flat thin housing plate 17 situated opposite the anchor plate 16 (see FIG. 3). The housing plate 17 is, in FIGS. 1 and 2, covered with a cover plate 18.

Furthermore, at the face side on the base unit 12, there is provided a face portion 19, the outer side of which is oriented transversely with respect to the plane of the anchor plate 16. The respective pivot arms of the pivot arm arrangement 14 extend through a rectangular aperture 20 in the face portion 19. The width of the face portion 19, formed as a plug-on component, corresponds to a conventional width a of the side wall 4 of 16 millimeters. The total width or thickness of the fitting units 10 and 11 amounts to approximately 12 millimeters, such that accordingly the respective material aperture in the side walls 4 and 5 has a depth of likewise approximately 12 millimeters, resulting in a remaining base thickness of the side walls 4, 5 in the region of the respective material aperture of approximately 4 millimeters.

FIG. 3 shows the fitting unit 10 without cover plate 18 and without face portion 19 in a pivoted-out position of the pivot arm arrangement 14. The housing plate 17 has been lifted off from the anchor plate, whereby components arranged at the inside on the anchor plate 16, such as the force store 21 and the damper device 22, can be seen.

The pivot arm arrangement 14 has multiple pivot arms which are articulatedly connected to one another, and some of which are constructed from two spaced-apart pivot arm plates. Of the pivot arms, a pivot arm 23 and a pivot arm 24 will be highlighted below, which are articulatedly connected to one another by means of a further pivot arm. The pivot arm 23 is constructed from two spaced-apart pivot arm plates 23*a* and 23*b* of identical form, and the pivot arm 24 is likewise constructed from two spaced-apart pivot arm plates 24*a* and 24*b* of identical form. The respective pivot arm plates 23*b* and 24*b* directed toward the anchor plate 16 form a first outer side of the pivot arm arrangement 14, and the respective pivot arm plates 23*a* and 24*a* directed toward the housing plate 17 form a second outer side of the pivot arm arrangement 14. The two pivot arm plates 23*a* and 24*a* are in exact alignment with one another, as are the two pivot arm plates 23*b* and 24*b*. The pivot arm plates 23*a*, 23*b* and the pivot arm plates 24*a*, 24*b* are in each case connected to one another by means of rivet connections, wherein rivet heads 26 project at both sides, or in each case at the outside, from the pivot arm plates 23*a*, 23*b* and 24*a*, 24*b* somewhat, for example, in the range of tenths of a millimeter.

Figure 6:
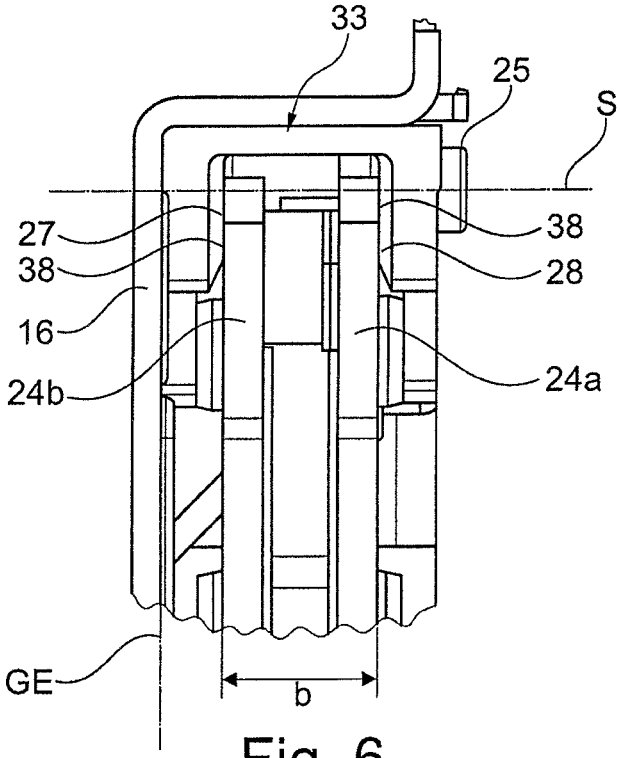
FIG. 6 shows the region C circled in FIG. 5 in an enlarged illustration.
Figure 7:
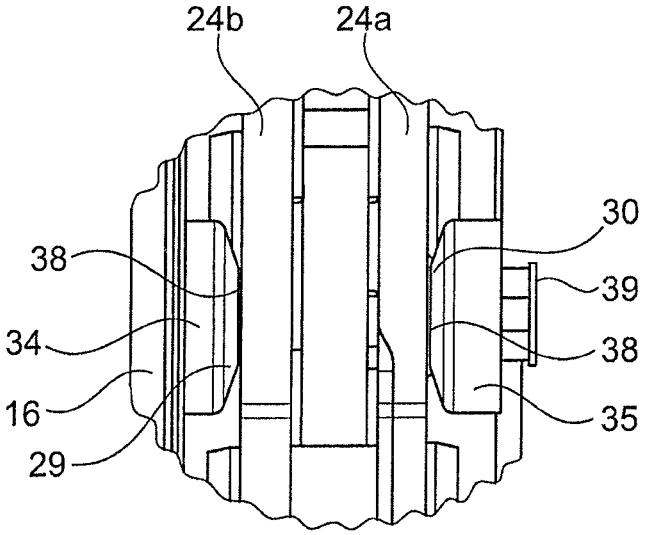
FIG. 7 shows the region D circled in FIG. 5 in an enlarged illustration.

The pivot arms 23 and 24 thus form a maximum width b of the pivot arm arrangement 14 (see FIG. 6), wherein, at the locations of the rivet connections of the pivot arm plates 23*a*, 23*b* and 24*a*, 24*b*, there is a slightly greater width than at the outer flat sides of the pivot arm plates 23*a*, 23*b* and 24*a*, 24*b*.

The pivot arm 23 is pivotable about a pivot axis S provided by an axle pin 25, wherein the pivot axis S is oriented transversely with respect to an anchor plate plane GE spanned by the anchor plate 16. In FIGS. 1-4, the pivot arm arrangement 14 or the top flap 3 is situated in an open position in which it has been opened to a maximum extent or has been pivoted out to a maximum extent, whereas FIGS.

Figure 8:
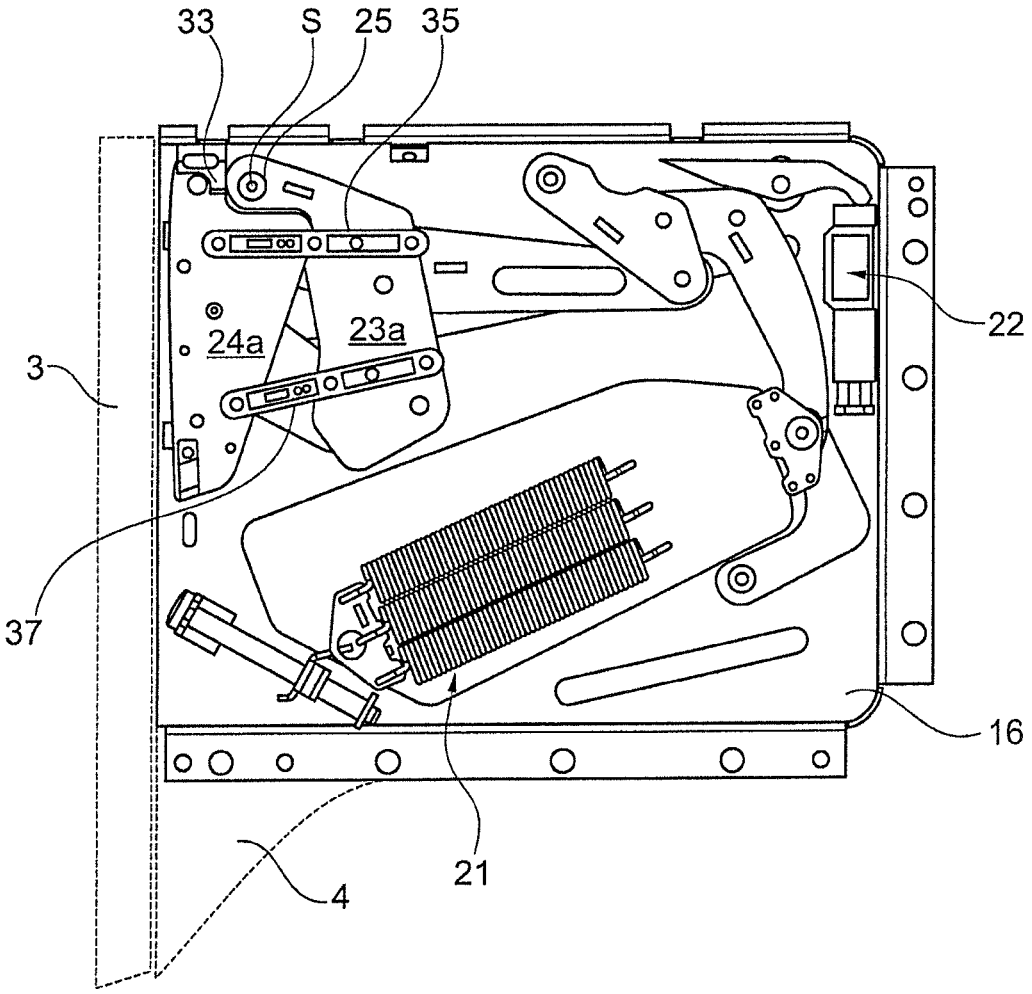
FIG. 8 shows the fitting unit as per FIG. 5 in a side view with indicated portions of the item of furniture in the case of a closed furniture part.

5-8 show the position of the pivot arm arrangement 14 in which it has been pivoted in to a maximum extent, without a mounting unit, in which the entire pivot arm arrangement 14 is accommodated in recessed fashion in the base unit 12 between the anchor plate 16 and the housing plate 17. In FIG. 8, portions of the closed top flap 3 and of the side wall 4 are indicated by dashed lines.

In an intermediate region between the pivot arm arrangement 14 and the base unit 12, there are formed a positioning mechanism with a positioning portion.

Specifically, by way of example, positioning portions designed as slide tracks 27-32 are provided both between the anchor plate 16 and the pivot arm arrangement 14 and between the housing plate 17 and pivot arm arrangement 14.

In a front upper corner region in the interior of the base unit 12, there is provided a U-shaped slide element 33 with the opposite slide tracks 27, 28, wherein the slide tracks 27, 28 are in each case directed inward, that is to say the slide track 27 is directed toward the pivot arm plates 23*b*, 24*b* and the slide track 28 is directed toward the pivot arm plates 23*a*, 24*a*.

Somewhat below the slide element 33, a strip-like slide element 34 with the slide track 29 is provided on the anchor plate 16 and is mirror-symmetrical with respect to an identical strip-like slide element 35 with the slide track 30, which is held on the housing plate 17. The slide track 29 is directed inward toward the pivot arm plates 23*b*, 24*b*, and the slide track 30 is directed inward toward the pivot arm plates 23*a*, 24*a*.

Again somewhat below the slide elements 34, 35, a strip-like slide element 36 with the slide track 31 is provided on the anchor plate 16 and is mirror-symmetrical with respect to an identical strip-like slide element 37 with the slide track 32, which is held on the housing plate 17. The slide track 31 is directed inward toward the pivot arm plates 23*b*, 24*b*, and the slide track 32 is directed inward toward the pivot arm plates 23*a*, 24*a*.

The slide elements 33-37 are positioned such that, over the course of an entire pivoting movement of the pivot arm arrangement 14, that is to say during the opening into the fully open position as per FIGS. 1 and 2, and during the closing movement into the fully closed position as per FIG. 8, none of the rivet heads 26 on the pivot arm plates 23*a*, 23*b*, 24*a*, 24*b* can pass or make contact with the slide tracks 27-32.

In the ideal state of the pivot arm arrangement 14 in the case of an absolutely ideal position of all of its pivot arms with regard to the axial position in the direction of the pivot axis S, there is a relatively very narrow air gap 38 in each case between the respective slide tracks 27-32 and the respectively opposite portions of the pivot arm plates 23*a*, 23*b*, 24*a*, 24*b*.

In practice, there is generally a slight misalignment of the pivot arm arrangement 14, or the pivot arms of the pivot arm arrangement 14 deviate slightly in an axial direction with respect to the pivot axis S from a setpoint bearing position, for example, in the range of tenths of a millimeter.

These slight misalignments have hitherto been able to lead to undesired friction noises during the closing process of the top flap 3 or of the pivot arm arrangement 14.

With the positioning mechanism according to the present invention, comprising the slide elements 33-37 with the slide tracks 27-32, in the case of misalignments of the pivot arm arrangement 14, the slide tracks 27-32 make abutting contact with the portions of the outer sides on the pivot arm plates 23*a*, 23*b*, 24*a*, 24*b*, wherein the outer sides on the pivot arm plates 23*a*, 23*b*, 24*a*, 24*b* form abutment surfaces which make sliding contact with the slide tracks 27-32.

Since the slide tracks 27-32 are preferably composed of a friction-minimizing material, such as, for example, a Teflon material or a PTFE material, it is possible to realize a minimization of friction and/or noise in the event of misalignments of the pivot arm arrangement 14.

Alternatively or additionally to the arrangement of slide elements attached to the base unit 12 or the anchor plate 16 and the housing plate 17, it is basically possible for slide elements with slide tracks to be attached to the outer sides of the pivot arm plates 23*a*, 23*b*, 24*a*, 24*b* and/or to the edge of the aperture 20 in the face portion 19.

The attachment of the slide elements 34-37 to the anchor plate 16 and/or the housing plate 17 is advantageously realized in detachable fashion and manually by means of spigots 39 on the slide elements 34-37 and matching recesses 40. For example, multiple or three spigots 39 are provided in projecting fashion on that side of the slide elements 34-37 which is situated opposite the respective slide track 29-32, which spigots can be engaged with detent action into suitably prepared recesses 40 in the anchor plate 16 and/or in the housing plate 17.

LIST OF REFERENCE DESIGNATIONS

1 Wall cupboard
2 Furniture body
3 Top flap
4 Side wall
4*a* Inner side
5 Side wall
6 Bottom side
7 Top side
8 Rear wall
9 Top flap fitting
10 Fitting unit
11 Fitting unit
12 Base unit
13 Guide
14 Pivot arm arrangement
15 Mounting unit
16 Anchor plate
17 Housing plate
17*a* Portion
18 Cover plate
19 Face portion
20 Aperture
21 Force store
22 Damper device
23 Pivot arm
23*a* Pivot arm plate
23*b* Pivot arm plate
24 Pivot arm
24*a* Pivot arm plate
24*b* Pivot arm plate
25 Axle pin
26 Rivet head
27 Slide track
28 Slide track
29 Slide track
30 Slide track
31 Slide track
32 Slide track
33 Slide element
34 Slide element
35 Slide element

36 Slide element
37 Slide element
38 Air gap
39 Spigot
40 Recess

The invention claimed is:

1. A device for moving a furniture part held on a furniture body of a furniture item, the device comprising:

a guide having at least one pivot arm for pivoting the furniture part so that the furniture part is moved from a closed position into an open position relative to the furniture body and back;

a base unit having an anchor plate with a counterpart plate mountable thereon, wherein the guide engages the anchor plate such that a pivot axis about which the at least one pivot arm is pivotable is transverse with respect to an anchor plate plane spanned by the anchor plate; and a positioning mechanism having a positioning portion formed in an intermediate region between the at least one pivot arm and the base unit, wherein the positioning portion is provided such that, during a pivoting movement of the at least one pivot arm, the positioning portion contacts an abutment surface provided on the pivot arm and/or on the base unit, wherein with guidance on both sides and in identical fashion and/or simultaneously via the two outer sides of the pivot arm by the abutment surface or positioning portion on the anchor plate and the counterpart plate, fine positioning is realized with the contact of the pivot arm on both sides with the abutment surface or positioning portion, and whereby fine positioning of the pivot arm in an axial direction relative to the pivot axis of the pivot arm is configurable by contact of the positioning portion with the abutment surface if the pivot arm has an axial offset with respect to a setpoint bearing position of the pivot arm.

2. The device as claimed in claim 1, wherein the abutment surface is defined by an outer side of the at least one pivot arm.

3. The device as claimed in claim 1, wherein the abutment surface is defined by an inner side of the base unit.

4. The device as claimed in claim 1, wherein the abutment surface is provided on the anchor plate of the base unit.

5. The device as claimed in claim 1, wherein the abutment surface on the base unit is defined exclusively in a region of the base unit that is not swept over by predefined portions of the outer side of the at least one pivot arm during the course of a complete pivoting movement of the pivot arm arrangement.

6. The device as claimed in claim 1, wherein the abutment surface is provided on the counterpart plate that is situated opposite to the anchor plate of the base unit.

7. The device as claimed in claim 1, wherein the abutment surface is assigned to a face-side cover element that is attachable to the base unit.

8. The device as claimed in claim 1, wherein the abutment surface is defined as a positioning portion that corresponds to the positioning portion on the pivot arm.

9. The device as claimed in claim 1, wherein the positioning portion comprises an attachment element for attachment to the base unit and/or to the pivot arm.

10. The device as claimed in claim 9, wherein the attachment element is attachable to the base unit and/or to the pivot arm.

11. The device as claimed in claim 1, wherein the positioning portion is formed from a plastic material.

12. The device as claimed in claim 1, wherein the base unit is connected to a mounting unit via a pivot arm of the guide, wherein the mounting unit is adapted for recessed attachment in a region of a material recess of the furniture part.

13. A furniture item comprising:

a furniture body; and a movable furniture part, including the device of claim 1, held on the furniture body.

* * * * *